United States Patent [19]

Dashuk

[11] 4,092,559

[45] May 30, 1978

[54] CONTROLLED DISCHARGER

[76] Inventor: Pavel Nikanorovich Dashuk, Svetlanovaky prospekt 39, kv. 45, Leningrad, U.S.S.R.

[21] Appl. No.: 722,051

[22] Filed: Sep. 9, 1976

Related U.S. Application Data

[63] Continuation of Ser. No. 588,961, Jun. 20, 1975, abandoned.

[51] Int. Cl.[2] ..... H01J 17/00

[52] U.S. Cl. ..... 313/192; 313/197; 313/308

[58] Field of Search ..... 313/192, 197, 308

[56] References Cited

PUBLICATIONS

Dashuk et al., "Technique of High Pulsating Currents and Magnetic Fields," Atomizdat Publishers, 1970, Moscow.

Putman et al. "I.R.E. Trans. Nucl. 9, No. 2, 74 (1962).

*Primary Examiner*—James B. Mullins
*Assistant Examiner*—Darwin R. Hostetter
*Attorney, Agent, or Firm*—Haseltine, Lake & Waters

[57] ABSTRACT

Disclosure is made of a low-inductance (L = 0.5 to 3 mH) controlled discharger for commutating megampere currents, having a maximum controllability range with respect to voltage, and a small operation lag. The low inductance and high transmitting capacity are due to the formation by a creeping discharge of a multichannel (from 10 to 40 channels) breakdown over the surface of a thin-layer dielectric element. Two main electrodes and one control electrode placed therebetween are arranged on one side of a dielectric element of a flat or cylindrical shape, whose reverse side has a current-conducting layer. The multichannel discharge accounts for small electrode erosion and, in combination with the gas-generating properties of the dielectric, ensures multiple operation of the discharger.

8 Claims, 6 Drawing Figures

CONTROLLED DISCHARGER

This is a continuation of application Ser. No. 588,961 filed June 20, 1975, now abandoned.

The present invention relates to electrophysics and, more particularly, to heavy-current controlled dischargers (closing switches) and is applicable for high-speed connection of pulsed energy accumulators (capacitance, inductance, explosion, etc.) to a load.

In today's science and engineering there are employed on an increasingly large scale different types of pulsed electro-physical installations comprising energy accumulators, wherefrom energy is released over a short period of time (from $10^{-8}$ to $10^{-4}$ sec) to a load for the production of super-strong magnetic fields, for the production and confinement of high-temperature plasma in plants intended for studies in controlled thermonuclear fusion, and, finally, for shaping metals and dielectrics in electrical engineering.

For quick connection of a pulsed energy accumulator to a load, present-day accumulators include controlled dischargers capable of commutating currents of from $10^3$ to $10^6$ A.

There are known the following basic types of controlled dischargers: vacuum dischargers, atmospheric and elevated pressure dischargers, and solid-body dischargers (dischargers wherein a breakdown of a solid dielectric takes place).

Each of the foregoing types of dischargers is intended for operation under specific conditions and has its advantages and drawbacks.

Vacuum dischargers, for example, feature a wide controllability range and great current transmitting capacity, but their electrodes do not have adequate erosion resistance in commutating heavy currents because of the pinch effect in the plasma in the discharge chamber. In addition, such dischargers must incorporate sophisticated equipment for continuously pumping out the discharge chambers to reach a high vacuum therein, and are hard to maintain.

There are further known dischargers operating under atmospheric pressure and in a compressed gas. In such dischargers the breakdown is either single-channel or has a limited number of channels, corresponding to that of ignition means, with each of these means initiating a breakdown of its own channel. The foregoing factors also account for low erosion resistance of this type if discharger, as well as for the impossibility of considerably reducing its inductance.

The known types of solid-dielectric dischargers have a sufficiently low inductance and a broad voltage controllability range; yet these are, in fact, single-action dischargers, which means that in such dischargers the dielectric has to be replaced after each discharge. The considerably high current transmitting capacity ($I = 1$ to 2 megamperes) of such dischargers is also due to the presence of a number of igniting devices, with each device initiating a breakdown of its channel. The erosion resistance of such dischargers is low, as each channel (whose number is limited) commutates heavy currents, which leads to rapid electrode wear and necessitates electrode replacement after a series of discharges.

A prototype of the prior art closest to the present invention is a cascade-type discharger operating at atmospheric and elevated pressures.

A description of the above-mentioned type of discharger is contained, for example, in the monograph by P. N. Dashuk, "Technika polucheniya bolshikh impulsnykh tokov i magnitnykh polyey"/"Ways and Means for Generating Heavy Pulse Currents and Magnetic Fields"/, Atomizdat Publishers, where this cascade-type discharger is described on pp. 219–220.

The same type of discharger is described in T. M. Putman, E. L. Kemp, I. R. E. Trans. Nucl., 9, No. 2, 74 (1962).

A discharger of this type comprises two main electrodes of a hemispheric shape mounted on a dielectric discharge chamber, and one control electrode arranged between the main electrodes, the working surfaces of said control electrode being confined on two sides by the hemispheres.

As a voltage pulse is applied to the control electrode, one of the spark gaps is bridged, the second gap (the one between the control electrode and the second main electrode) being bridged after the first gap, under the action of the full operating voltage which is applied thereto after the bridging of the first spark gap. For improved erosion resistance, the central portions of all the electrodes have inserts of a tungsten alloy.

The single-channel breakdown in such a discharger and the ensuring destruction of the central portions of the electrodes account for a low current transmitting capacity of such dischargers, which is not in excess of $2\times10^5$A. The great spacing between the return conductor and the spark channel accounts for considerably high inductance which amounts to 30 to 50 mH (at an operating voltage of 30 to 50 kV). Finally, the successive breakdowns of spark gaps, involving the breakdown of one of the spark gaps by the operating voltage (and not by the initiating pulse), limits the controllability range of dischargers with respect to the voltage to a narrow range of $0.3+1$.

It is an object of the present invention to substantially reduce the inductance, enlarge the controllability range with respect to the voltage practically to a maximum possible limit (from 0 to 1), and raise the transmitting capacity of dischargers by reducing the electrode erosion.

The foregoing objects are attained by providing a controlled discharger comprising direct and reverse current buses electrically connecting a load and a power source to two main electrodes having a control electrode arranged therebetween, which control electrode is electrically connected to one of the poles of an initiating pulse channel, and a dielectric element insulating said electrodes from one another, wherein, according to the invention, said main end controlling electrodes are arranged on one side of the dielectric's surface, the thickness of the dielectric being less than the distance between the main electrodes, whereas the opposite side of the dielectric is provided, over the area corresponding to the gap between the main electrodes, with a current-conducting layer electrically connected to at least one of the main electrodes and the other pole of the initiating pulse channel so that the control electrode produces a multichannel creeping discharge on the surface of the dielectric, directed towards the main electrodes.

Thus, the spark channel is produced, in accordance with the invention, in the form of a multichannel breakdown adjoining the surface of the thin dielectric layer upon which the electrodes are mounted. Such a discharger with electrodes extending along the dielectric's surface, in the direction perpendicular to that of the current, makes it possible to produce a multichannel creeping discharge between the electrodes along the entire perimeter of the electrodes.

It is expedient that said dielectric be a flat plate and that a replaceable insulation layer be arranged between the surface of the dielectric and the electrodes.

The small thickness of the dielectric between the discharge plasma layer and the reverse current conductor accounts for a sharp decrease in the discharger's inductance. The longitudinal flat or annular form of a discharge on the electrode surface accounts for small current densities in the electrode, high erosion resistance and, correspondingly, high transmitting capacity of the discharger.

One can also use the current-conducting layer as part of the reverse current bus.

The mechanism of forming a creeping discharge on the surface of the solid dielectric in this discharger design ensures the formation of a multichannel breakdown by one initiating device which applies one voltage pulse to the control electrode. It should be pointed out that the discharger in actuated at any voltage across the main electrodes (from 0 to operating voltage).

According to an alternative embodiment of the present invention, it is expedient that the reverse current bus be located in immediate proximity to said current-conducting layer. In this case the reverse current bus must be insulated from the current-conducting layer.

It is also desirable that the current-conducting layer, insulated from the direct and reverse current buses, be connected to the main electrodes via power resistors which are arms of a voltage divider.

It is possible to connect the current-conducting layer to at least one of the main electrodes via a capacitor device.

In still another embodiment of the invention the dielectric may be shaped as a cylinder having a main and the control electrodes being mounted on its outer surface, said electrodes being made as rings coaxially enveloping the cylinder. The current-conducting layer is arranged in this case on the internal surface of the cylinder, whereas the reverse current bus is arranged axially inside the dielectric cylinder.

Other objects and advantages of the invention will become more apparent from the following detailed description of preferred embodiments thereof taken in conjunction with the accompanying drawings, wherein.

Figure 1:
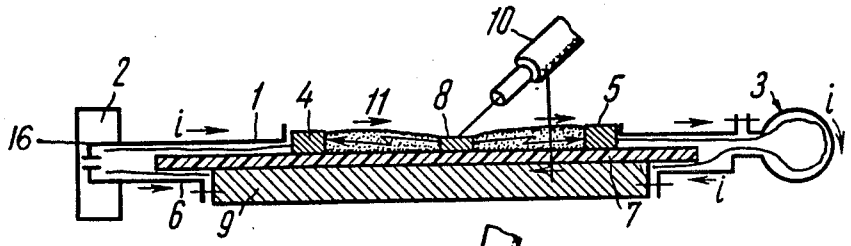
FIG. 1 is an elevation view of a controlled discharger in accordance with the invention.

Referring now to the attached drawings, the controlled discharger of the present invention comprises direct-current buses 1 (FIG. 1) connecting a power source 2 and a load 3 to two main electrodes 4 and 5, and a reverse current bus 6 connecting the load 3 to the power source 2. The function of the power source 2 may be performed by a capacitor power accumulator comprising a plurality of capacitors that are interconnected in parallel. The load 3 in FIG. 1 is a single-coil solenoid intended to produce a pulsed magnetic field. The direct and reverse current buses 1 and 6, respectively, may be made as current-conducting metal sheets or as a plurality of parallel-connected cables.

Arranged between the main electrodes 4 and 5 disposed on one side of a flat dielectric element 7 is a control electrode 8.

The main electrodes 4 and 5 and the control electrode 8 are made, according to FIG. 1, as metal (steel, copper, etc.) buses of a round or rectangular cross-section, extending in the direction perpendicular to that of the current. The distance between the main electrodes 4 and 5 and the control electrode 8 is selected so as to ensure reliable insulation of the power source 2 from the load 3 at a preselected constant operating voltage.

The thickness of the dielectric element 7 is much smaller than the distance between the main electrodes 4 and 5 and the control electrode 8.

The dielectric element 7 must be made of dielectrics having good impact resistance and gas-generating properties when coming into a short-lived contact with plasma, such as fluoroplastic (teflon) or fiber-glass laminate. Organic glass and polyethylene are also good for the purpose.

In the embodiment under review the dielectric element 7 (FIG. 2) is a thin flat glass plastic sheet whose plan dimensions are in excess of the width of the main electrodes 4 and 5 and the distance therebetween.

Directly adjoining the opposite side of the dielectric element 7 is a current-conducting layer 9 which, according to FIG. 1, also is part of the reverse current bus 6. The current-conducting layer 9 covers the opposite side of the dielectric layer 7 over the entire portion between the main electrodes 4 and 5.

The current-conducting layer 9 is electrically connected to the main electrode 5 via the load 3 (the solenoid) and to the other main electrode 4 via a capacitor 16 of the power source 2.

The connection between the current-conducting layer 9 and one or both main electrodes 4 and 5 may be direct conductive or capacitive connection.

The current-conducting layer 9 may be made as a metal (which may be aluminium, copper or some other current-conducting material) foil or thin plate. This layer is applied onto the opposite side of the dielectric element 7 by means of metallization.

One pole of an initiating pulse channel 10 is connected to the control electrode 8, its other pole being connected to the portion of the current-conducting layer 9 located directly above the zone where a multichannel discharge is produced.

The function of the initiating pulse channel 10 may be performed by a single coaxial cable. The pulse itself must be an aperiodic or oscillatory voltage pulse.

Figure 2:
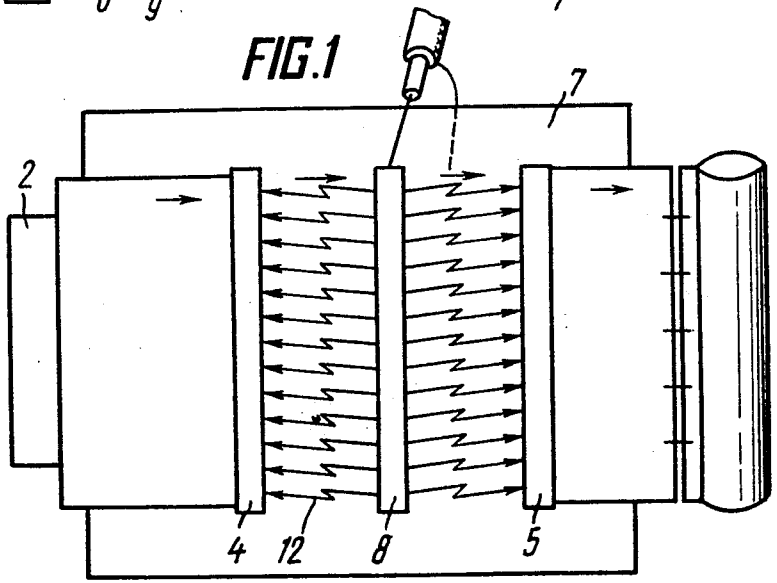
FIG. 2 is a plan view of a controlled discharger in accordance with the invention.

Arrows 11 in FIGS. 1 and 2 indicate current directions in the discharger. Broken arrows 12 conventionally indicate the direction of the development of a multichannel discharge stages of its formation as it originates at the control electrode 8.

Figure 3:
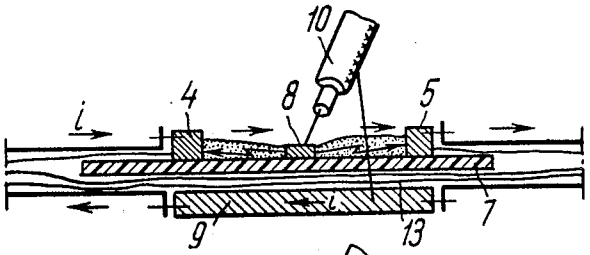
FIG. 3 is a view of an alternative embodiment of the controlled discharger.

FIG. 3 shows an alternative embodiment of a controlled discharger which differs from the foregoing embodiment in that according to the invention, the dielectric element 7 in said second embodiment is composite and consists of a flat dielectric plate which is to be replaced after a certain number of dischargers (in this case the dielectric does not have the electric strength corresponding to the full operating voltage) and of an additional layer 13 made, for example, of a multilayer dielectric film (polyethylene, polyethyleneterephthalate, mylar, etc.) which is joined to the insulation placed between the direct and reverse current buses 1 and 6, respectively.

Figure 4:
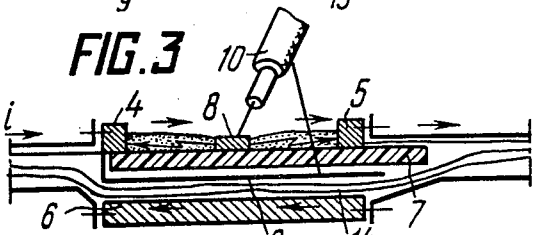
FIG. 4 shows another embodiment of the controlled discharger in accordance with the invention.

Still another embodiment of the invention is shown in FIG. 4. It is characterized in that the current-conducting layer 9 on the opposite side of the dielectric element 7 is not part of the reverse current bus 6 (as is the case with the embodiments of FIGS. 1, 2 and 3), but is insulated therefrom by a thin insulating film 14. This accounts for low inductance of the discharger, as the reverse current bus 6 is close to the path of direct current of the multichannel breakdown on the surface of the dielectric element 7.

Figure 5:
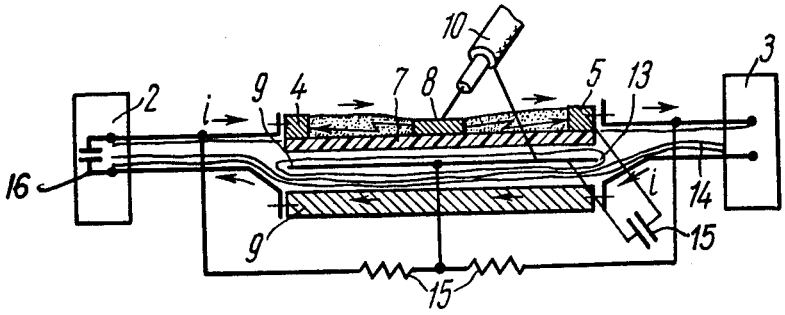
FIG. 5 shows still another embodiment of the controlled discharger in accordance with the invention.

Still another embodiment of the present invention is shown in FIG. 5. In this case the current-conducting layer 9 is connected to both main electrodes 4 and 5 via power resistors 15 which serve as a direct voltage divider and apply, under the charging conditions, to said current-conducting layer 9 voltage which is intermediate between the voltage across the main electrode 4 connected to the power source 2, and the voltage across the main electrode 5 connected to the load 3. Thus, while maintaining a minimum distance between each of the main electrodes 4 and 5 and the current-conducting layer 9 (which is necessary for the formation of a multichannel creeping discharge), this design ensures reduction in the intensity of the electric field in the proximity of the main electrodes 4 and 5 under the charging conditions, which rules out spontaneous operation of the discharger and makes it possible to use said discharger at an increased operating voltage. In order to improve the formation of the multi-channel creeping discharge by means of the discharger shown in FIG. 5, the current-conducting layer 9 can be connected to at least one of the main electrodes, for example electrode 4, through a capacitor 16 having a value of $C \geqq 0.1\mu$ F for the embodiment illustrated in FIG. 5.

Figure 6:
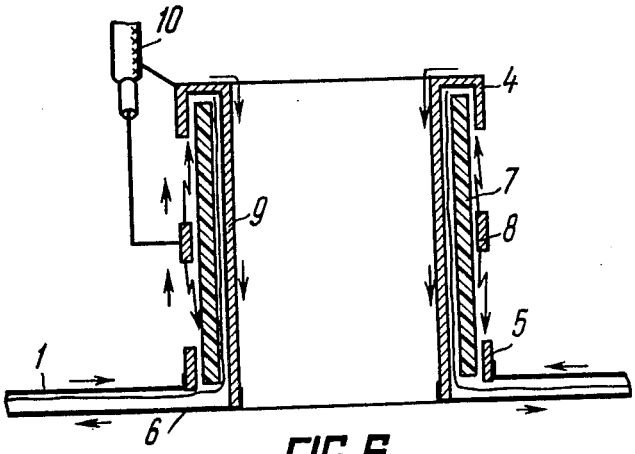
FIG. 6 shows an embodiment of the controlled discharger according to the invention, wherein the dielectric is cylinder-shaped.

FIG. 6 shows a controlled discharger, wherein the dielectric element 7 is shaped as a thin-wall cylinder at whose outer surface there are mounted the main electrodes 4 and 5 and the control electrode 8, said electrodes being made as rings abutting against the surface of the dielectric element 7. The current-conducting layer is located on the internal surface of the element 7 and is a portion of the reverse current bus 6.

The latter embodiment is advantageous in that it eliminates what is referred to as end effects observed at the end portions of the rectangular buses. This raises the reliability of the discharger (while preserving all the above-mentioned advantages) due to a more uniform distribution of channels along the perimeter of the electrodes.

The initiating pulse channel 10 may be connected in this case to the control electrode 8 and the main electrode 4 connected to the current-conducting layer 9 inside the dielectric element 7. It is also possible to connect the initiating pulse channel 10 to the control electrode 8 by passing it through the dielectric element 7 and the reverse current bus 6.

In yet another embodiment of the present invention with the use of a cylinder-shaped dielectric element the main electrodes and the control electrode are placed on the internal side of the dielectric element. In this case the current-conducting layer is on the outer side of the cylinder. (This embodiment is not shown in the drawings).

An initiating voltage pulse is applied to the discharger via the channel 10 connected directly to the control electrode 8 and the current-conducting layer 9 arranged on the opposite side of the dielectric element 7, between the main electrodes 4 and 5. Creeping discharge sparks proceed from the control electrode 8 in both directions toward the main electrodes 4 and 5. This discharges are formed as a multichannel net due to the small thickness of the dielectric plate (which is less by far than the distance between the electrodes) and high electric field intensity at the spark heads. After the creeping discharge arrives from the electrode 8 at the main electrodes 4 and 5, the latter become closed, and the discharge current of the main circuit of the power source 2, i.e. of the energy accumulator, follows along the multichannel path.

Due to the fact that the initiating creeping discharge develops simultaneously on both sides of the electrode 8, the discharger is actuated at any (even at zero) voltage between the main electrodes 4 and 5. The actuating time and actuating lags are kept at a minimum, as these are determined by the development of the discharge from the initiating voltage pulse applied via the channel 10.

The development of the multichannel discharge, which is distributed uniformly along the flat or annular electrodes, reduces the electrode arosion and raises the transmitting capacity of the discharger, which may reach several megamperes.

The surface of the dielectric element, along which the discharge develops as it interacts with the plasma evaporates and is rid of the discharge products. At current loads of 30+40 kA per one centimeter of the electrode perimeter (across the current) and durations of 100+200 msec the destruction of the dielectric element is practically negligible, which ensures repeated operation of the discharger without replacing the dielectric element.

What is claimed is:

1. A controlled discharger comprising direct and reverse current buses; two main electrodes electrically coupled to a load and a power source with the aid of said direct and reverse current buses; a control electrode arranged between said main electrodes; an initiating pulse channel having one of its poles electrically connected to said control electrode; a dielectric element having said main electrodes and said control electrode mounted on one of its sides, its opposite side being provided, at the portion corresponding to the gap between the main electrodes, with a current-conducting layer electrically connected to at least one of said main electrodes and the other pole of said initiating pulse channel, the thickness of said dielectric element being less than the distance between said main electrodes, so that as an initiating pulse is applied to said control electrode, a multichannel discharge is formed on the surface of said dielectric element.

2. A controlled discharger as claimed in claim 1, wherein the dielectric element is a flat plate.

3. A controlled discharger as claimed in claim 1 wherein said dielectric element is replaceable, and including a main thin-layer insulating film between said dielectric element and the reverse-current conducting layer.

4. A controlled discharger as claimed in claim 3, wherein said current-conducting layer is part of the reverse current bus.

5. A controlled discharger as claimed in claim 3, wherein said current-conducting layer is insulated from said reverse current bus arranged in immediate proximity to said current-conducting layer.

6. A controlled discharger as claimed in claim 5, wherein said current-conducting layer is insulated from said reverse current bus and connected to said main electrodes via power resistors which are arms of a voltage divider.

7. A controlled discharger as claimed in claim 6, including capacitor means, said current-conducting layer being connected to at least one of said main electrodes through said capacitor means.

8. A controlled discharger comprising direct and reverse current buses; two main electrodes electrically coupled to a load and a power source with the aid of said buses; a control electrode arranged between said main electrodes; an initiating pulse channel having one of its poles electrically connected to said control electrode; a dielectric element shaped as a cylinder, said main electrodes and said control electrodes being mounted on the outer surface of the cylinder and made in the form of rings coaxially enveloping said dielectric element whose internal surface, on the portion corresponding to the gap between the main electrodes, is provided with a current-conducting layer electrically connected with at least one of said main electrodes and the other pole of the initiating pulse channel, the thickness of said dielectric element being less than the distance between said main electrodes, so that as an initiating pulse is applied to said control electrode, there is formed a multichannel discharge on the surface of said dielectric element.

* * * * *